US007946539B2

(12) United States Patent
Lara

(10) Patent No.: US 7,946,539 B2
(45) Date of Patent: May 24, 2011

(54) DEVICE FOR SUPPORTING A SAFETY LINE

(75) Inventor: Pascal Lara, Nice (FR)

(73) Assignee: Capital Safety Group EMEA, Carros Cedex (FR)

( * ) Notice: Subject to any disclaimer, the term of this patent is extended or adjusted under 35 U.S.C. 154(b) by 758 days.

(21) Appl. No.: 11/919,128

(22) PCT Filed: May 23, 2006

(86) PCT No.: PCT/EP2006/062547

§ 371 (c)(1),
(2), (4) Date: Oct. 24, 2007

(87) PCT Pub. No.: WO2006/125785

PCT Pub. Date: Nov. 30, 2006

(65) Prior Publication Data

US 2010/0133389 A1 Jun. 3, 2010

(30) Foreign Application Priority Data

May 24, 2005 (FR) ..... 05 51359

(51) Int. Cl.
*F16L 3/08* (2006.01)
*A47L 3/04* (2006.01)

(52) U.S. Cl. ..... 248/65; 182/3; 182/36; 104/115

(58) Field of Classification Search ..... 248/65, 248/66, 73, 51, 56; 182/10, 230, 231, 3, 182/36; 104/115
See application file for complete search history.

(56) References Cited

U.S. PATENT DOCUMENTS

| | | | | |
|---|---|---|---|---|
| 5,224,427 | A * | 7/1993 | Riches et al. | 104/115 |
| 5,279,385 | A | 1/1994 | Riches et al. | |
| 5,979,599 | A | 11/1999 | Noles et al. | |
| 6,330,861 | B1 * | 12/2001 | Flux | 104/115 |
| 6,802,390 | B2 * | 10/2004 | Peterson et al. | 182/36 |

FOREIGN PATENT DOCUMENTS

| | | | |
|---|---|---|---|
| GB | 2 389 386 | A | 12/2003 |
| JP | 11-136825 | A | 5/1999 |
| WO | WO 02/092171 | A1 | 11/2002 |
| WO | WO 03/045504 | A1 | 6/2003 |

* cited by examiner

*Primary Examiner* — Anita M King
(74) *Attorney, Agent, or Firm* — IPLM Group, P.A.

(57) ABSTRACT

Device for supporting a safety line, in particular for preventing the accidental falling of personnel working in places presenting this risk, having at least one elongated tubular element for guiding the passage of the cable of the safety line, wherein this tubular element is retained by at least two supports, spaced apart and designed to be fixed to a fixed surface, characterized in that the elongated tubular element is of a flexible plastic material so that it is able to conform to the shape of a curve to be produced.

17 Claims, 3 Drawing Sheets

DEVICE FOR SUPPORTING A SAFETY LINE

CROSS-REFERENCE TO RELATED APPLICATIONS

The present application claims priority to PCT Application No. PCT/EP2006/062547 filed on May 23, 2006 which in turn claims priority to French Application No. 0551359 filed on May 24, 2005.

BACKGROUND OF THE INVENTION

This invention relates to a device for supporting a safety line, also called a life-line.

The safety lines of this type are designed to prevent accidental falling of personnel working at considerable heights.

The personnel are attached to this line by means of a strap which guarantees their safety while enabling them to move.

Such safety lines are described, for example, in the documents U.S. Pat. No. 5,224,427, WO 02/092171 and WO 03/045504.

The devices of prior art for supporting these safety lines comprise elongated tubular elements each adapted to guide the passage of the safety line cable. Each tubular element is fixed to a wall or other fixed surface by means of a support.

To produce a curve, in order to negotiate the corner of a building, for example, the cable is engaged in a steel bent tube whose curvature is adapted to the shape of the curve to be produced.

These bent steel tubes pose the following two problems, however.

Because of their rigidity, the bending of these tubes cannot be adapted locally to the curvature of the curve to be produced.

The friction of the cable in these bent tubes risks damaging it.

The object of this invention is to eliminate these drawbacks.

BRIEF SUMMARY OF INVENTION

According to the invention the device for supporting a safety line, and in particular, to prevent accidental falling of personnel working in places presenting this risk, comprising at least one elongated tubular element for guiding the passage of the cable of said safety line, this tubular element being retained by at least two supports spaced apart and designed to be fixed to a fixed surface, is characterized in that said elongated tubular element is of a flexible plastic material enabling it to conform to the shape of a curve to be produced.

This tubular element of a flexible plastic material therefore provides a simple, effective solution to the two problems described above in regard to the bent steel tubes.

The tubular element is preferably of polyamide, which is a flexible plastic material that is resistant and exhibits a low coefficient of friction with the steel cables.

Each of said supports preferably also retains the tubular element so that it has a freedom of rotation along its axis.

Therefore the tubular element does not risk being subjected to torsional stresses.

For this purpose each support preferably comprises, at one of its ends, a tubular cavity in which is engaged a section of the tubular element.

To block the tubular element axially relative to the supports, the section of the tubular element engaged in the tubular cavity of the support is limited at each end by an annular shoulder which forms a stop relative to the corresponding end of the tubular cavity of said support.

Other features and advantages of the invention will also be apparent from the following description.

BRIEF DESCRIPTION OF THE SEVERAL VIEWS OF THE DRAWINGS

In the attached drawings, given by way of non-exhaustive examples.

DETAILED DESCRIPTION OF THE INVENTION

Figure 1:
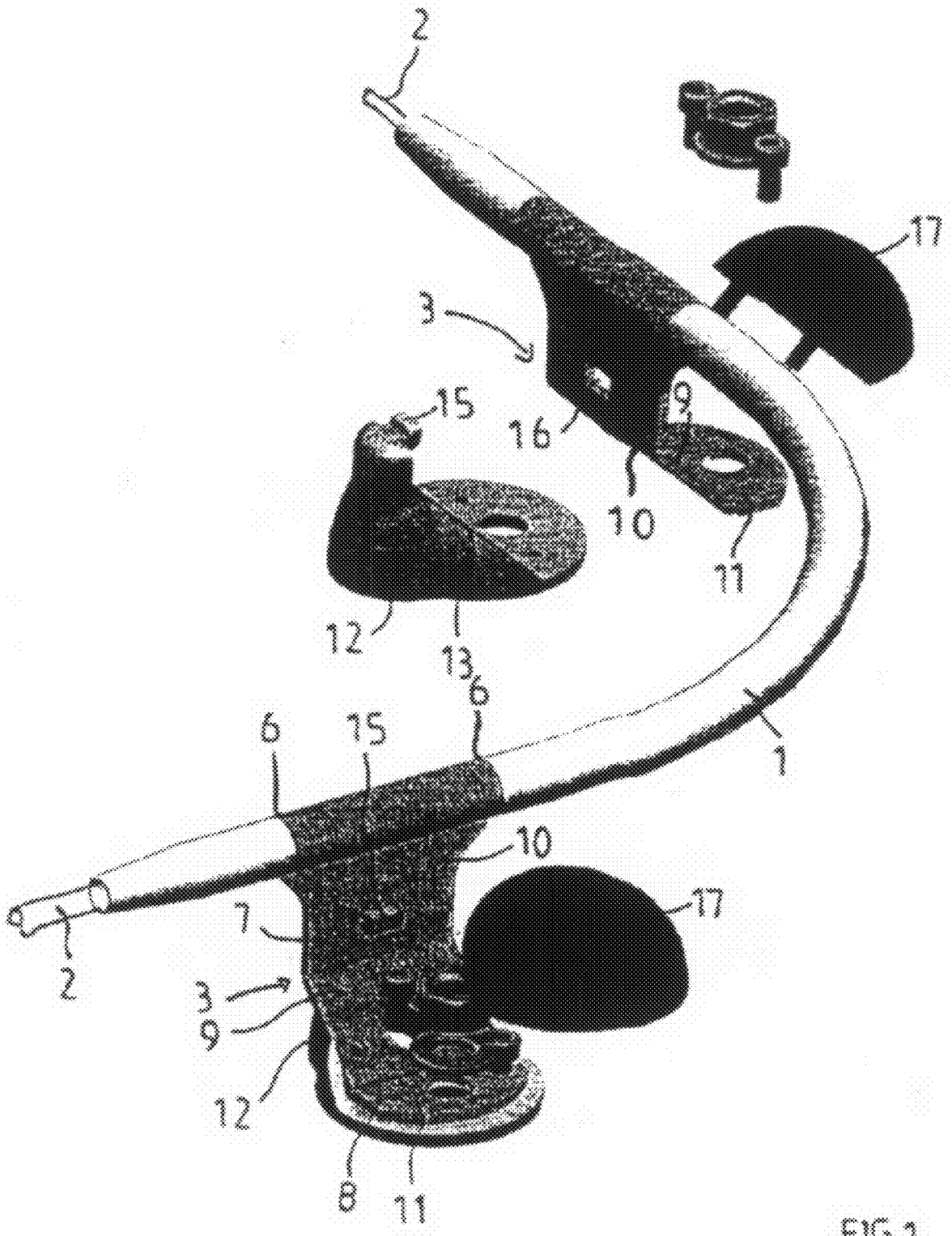
FIG. 1 is a perspective view of a device according to the invention for supporting a safety line.

As shown, particularly in FIG. 1, the device for in particular, to prevent the accidental falling of personnel working in places presenting such a risk, comprises at least one elongated tubular element 1 for guiding the passage of cable 2 of the safety line.

This tubular element 1 is retained by two supports 3, spaced apart and designed to be fixed to a fixed surface, such as a wall of a building.

According to the invention, elongated tubular element 1 is of a flexible plastic material so that it is able to conform to the shape of a curve to be produced.

Tubular element 1 is preferably of polyamide, including charges of EPDM copolymer (ethylene-propylene-diene).

Each of the two supports 3 retains tubular element 1 so that it has a freedom of rotation along its axis.

Figure 2:
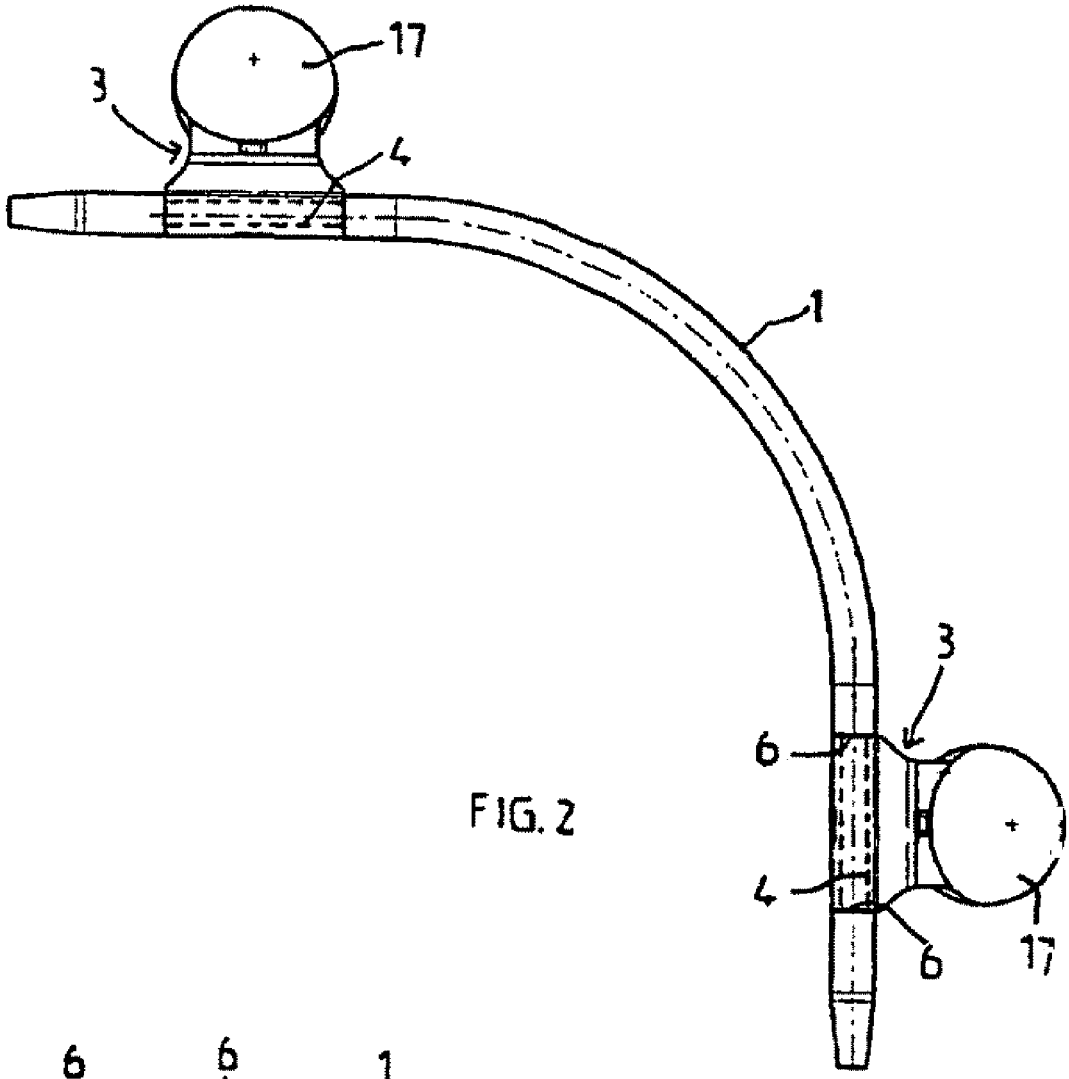
FIG. 2 is a plan view of the device shown in FIG. 1.
Figure 4:
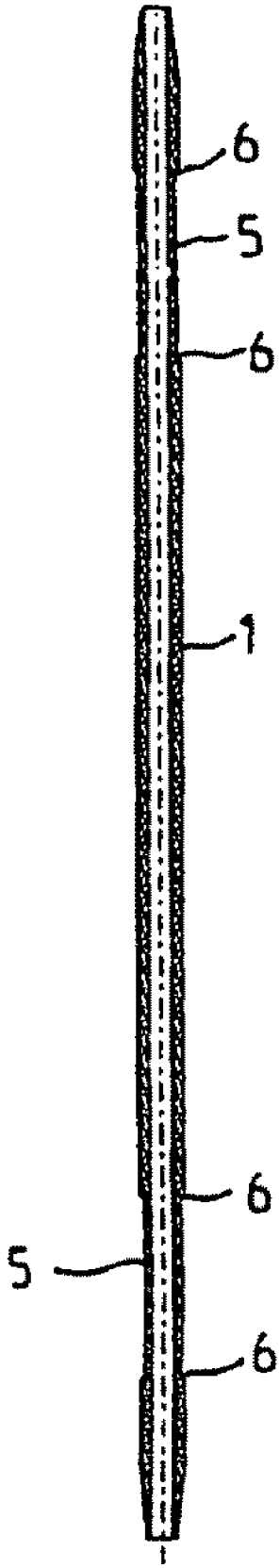
FIG. 4 is a view, in longitudinal section, of the tubular element of the device according to the invention, deprived of its fixing supports.
Figure 5:
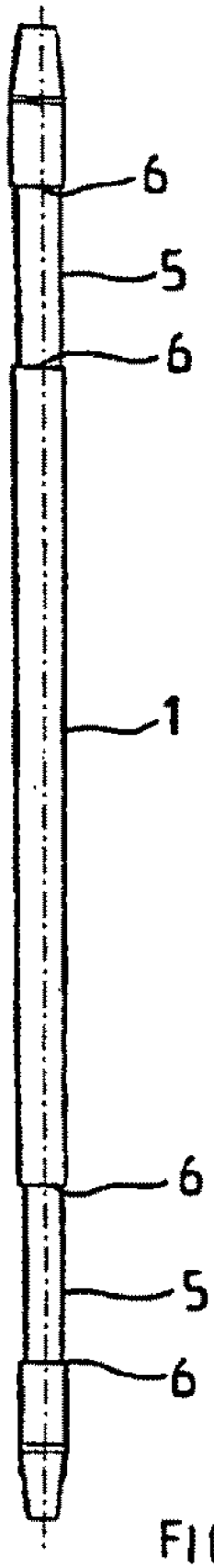
FIG. 5 is a plan view of the tubular element shown in FIG. 4.

For this purpose each support 3 comprises, at one of its ends (see FIG. 2), a tubular cavity 4 in which is engaged a shrunk-on section 5 (see FIGS. 4 and 5) of tubular element 1.

This shrunk-on section 5 of tubular element 1, engaged in tubular cavity 4 of support 3, is limited at each end by an annular shoulder 6, which forms a stop relative to the corresponding end of tubular cavity 4 of support 3.

Tubular element 1 is therefore blocked axially relative to supports 3, while being capable of rotating about its axis relative to the latter.

In the example shown (see FIGS. 1 and 3), each support 3 consists of a metal plate comprising two spaced bends 7, 8, perpendicular to the length of the metal plate to define an intermediate face 9, bounded by two end faces 10, 11 that are essentially perpendicular to each other.

Moreover, each support 3 comprises a base 12, designed to be supported on a fixed surface, a wall for example, and exhibiting an inclined surface 13 on which is supported intermediate face 9 of the metal plate.

This inclined surface 13 is connected to a surface 14 providing the support for end face 11 of the plate, which is opposed to tubular element 1.

Intermediate face 9 of the plate of support 3 may also be fixed directly to the fixed surface, i.e. without base 12.

Figure 3:
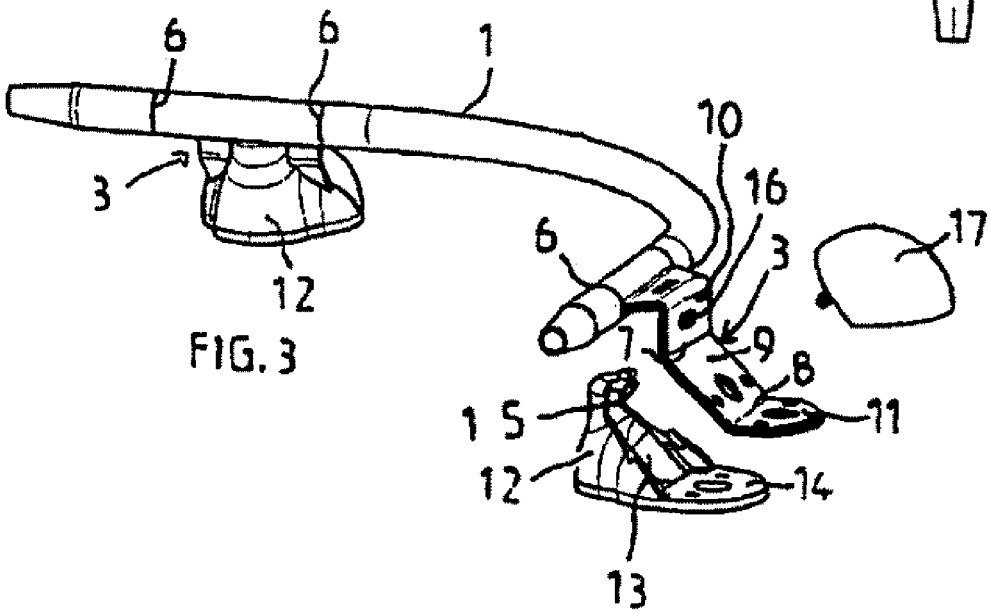
FIG. 3 is another perspective view of the device according to the invention.

It is also seen in FIGS. 1 and 3 that each base 12 comprises, in its upper section, a finger 15 that can be engaged in a hole 16 made in face 10 of the metal plate located close to tubular cavity 4.

When they are used, bases 12 increase the rigidity of the curve assembly under tension.

A more aesthetic appearance of the curve is thus produced.

To enable cable 2 of the safety line to make a curve, in order to negotiate the corner of a building, for example, the following procedure is adopted:

two holes, spaced part, are made on the wall of the building or on another fixed surface for fixing supports 3 of the device, tubular element 1 is bent manually so that the latter assumes the shape of the curve to be produced, supports 3 are fixed in relation to the two holes previously drilled in the wall or other fixed surface, supports 3 are covered by a cap 17.

It is then sufficient to engage cable 2 in tubular element 1.

The main advantages of the device that has just been described are as follows:

Whatever the angle to be formed between two safety line sections, the flexibility of the tubular element allows any configuration.

Therefore, at the time of installation of the safety line, there is no constraining measurement or gauge for positioning fixing holes in the fixed surface.

In fact, the accuracy of the drilling in the concrete is not evident. The flexibility of the tubular element therefore allows certain inaccuracies.

The desired angle may be achieved as a function of the configuration of the building without a specific bending tool, while this is the case on the steel tube systems, for example.

It is also easy to alter the length of the tubular element in order to change the configuration to be produced.

If a worker falls there is better distribution of the cable tension through the different sections of the tubular element because of the low coefficient of friction.

This low coefficient of friction reduces the stresses on the receiving structure or, in any case, these stresses are better distributed throughout the curve.

Tests have shown that this distribution was 50 to 80% more favorable than in the case of the steel tubes.

Better retention of the cable is provided in the event of falling insofar as the steel on steel friction has until now risked damaging the cable, which is not the case with the plastic tubular element of the device according to the invention.

The invention claimed is:

1. A device for supporting a safety line, in particular for preventing the accidental falling of personnel working in places presenting this risk, the device comprising:

at least one elongated tubular element for guiding the passage of a cable of said safety line, wherein the tubular element is retained by at least two supports spaced apart and designed to be fixed to a fixed surface, characterized in that said elongated tubular element is of a flexible plastic material, so that the elongated tubular element is able to conform to the shape of a curve to be produced; and each support retaining the elongated tubular element so that the elongated tubular element has a freedom of rotation along its axis, each support further including a tubular cavity that engages a respective section of the elongated tubular element, each respective section of the elongated tubular element being defined by annular shoulders that form stops that retain the tubular cavity of a respective support about the respective section of the elongated tubular element.

2. The device according to claim 1, characterized in that the tubular element is of polyamide.

3. The device according to claim 2, characterized in that each of said supports retains the tubular element so that it has a freedom of rotation along its axis.

4. The device according to claim 2, characterized in that each support consists of a metal plate comprising two bends spaced apart and perpendicular to the length of the metal plate in order to define an intermediate face bounded by two end faces essentially perpendicular to each other.

5. The device according to claim 2, characterized in that the tubular element is of polyamide including charges of EPDM copolymer (ethylene-propylene-diene).

6. The device according to claim 5, characterized in that each of said supports retains the tubular element so that it has a freedom of rotation along its axis.

7. The device according to claim 5, characterized in that each support consists of a metal plate comprising two bends spaced apart and perpendicular to the length of the metal plate in order to define an intermediate face bounded by two end faces essentially perpendicular to each other.

8. The device according to claim 1, characterized in that each support consists of a metal plate comprising two bends spaced apart and perpendicular to the length of the metal plate in order to define an intermediate face bounded by two end faces essentially perpendicular to each other.

9. The device according to claim 1, characterized in that each support consists of a metal plate comprising two bends spaced apart and perpendicular to the length of the metal plate in order to define an intermediate face bounded by two end faces essentially perpendicular to each other.

10. The device according to claim 1, characterized in that each support consists of a metal plate comprising two bends spaced apart and perpendicular to the length of the metal plate in order to define an intermediate face bounded by two end faces essentially perpendicular to each other.

11. A device for supporting a safety line, in particular for preventing the accidental falling of personnel working in places presenting this risk, the device comprising:

at least one elongated tubular element for guiding the passage of a cable of said safety line, wherein the tubular element is retained by at least two supports spaced apart and designed to be fixed to a fixed surface, characterized in that said elongated tubular element is of a flexible plastic material, so that the elongated tubular element is able to conform to the shape of a curve to be produced, further characterized in that each support consists of a metal plate comprising two bends spaced apart and perpendicular to the length of the metal plate in order to define an intermediate face bounded by two end faces essentially perpendicular to each other.

12. The device according to claim 11, characterized in that each support also comprises a base designed to be supported on said fixed surface and exhibiting an inclined surface on which is supported the intermediate face of said metal plate, which is connected to a surface providing a support for the end face of said plate opposed to the tubular element.

13. The device according to claim 12, characterized in that the intermediate face of the plate comprises means that enable it to be fixed directly on said fixed surface.

14. The device according to claim 12, characterized in that said base comprises, in its upper section, a finger that is able to engage in a hole made in said metal plate close to said tubular cavity.

15. A device for supporting a safety line comprising:

at least two spaced apart supports, each support configured and arranged to be coupled to a fixed surface; and at least one flexible elongated tubular element configured to conform to a shape of a curve, the at least one flexible elongated tubular member having a shrunk-on section for each support, each support coupled to the at least one flexible elongated tubular element about an associated shrunk-on section, the at least one flexible elongated tubular element having a passage that is configured and arranged to a receive a cable.

16. The device for supporting a safety line of claim 15, wherein each shrunk-on section in the at least one flexible elongated tubular element terminates in annular shoulders that form stops to retain a respective support coupled about the shrunk-on section from moving axially.

17. The device for supporting a safety line of claim 15, wherein at least one of the supports further comprises:

a plate having a length, the plate having at least two bends, the bends being spaced apart and perpendicular to the length of the plate, the bends defining an intermediate face that is bounded by two end faces that are essentially perpendicular to each other.

* * * * *

UNITED STATES PATENT AND TRADEMARK OFFICE

CERTIFICATE OF CORRECTION

PATENT NO. : 7,946,539 B2
APPLICATION NO. : 11/919128
DATED : May 24, 2011
INVENTOR(S) : Pascal Lara It is certified that error appears in the above-identified patent and that said Letters Patent is hereby corrected as shown below:

Column 2, Lines 24-25:
"...the device for in particular..." should read --...the device for supporting a life line in particular...--.

Column 3, Line 7:
"spaced part" should read --spaced apart--.

Column 5, Line 6, Claim 15:
"arranged to a receive" should read --arranged to receive--.

Signed and Sealed this
Eleventh Day of October, 2011

David J. Kappos

David J. Kappos
*Director of the United States Patent and Trademark Office*